US007654875B1

(12) United States Patent
Williams

(10) Patent No.: US 7,654,875 B1
(45) Date of Patent: Feb. 2, 2010

(54) SELF-CONTAINED HYDRAULIC THRUSTER FOR VESSEL

(76) Inventor: John T. Williams, 215 Avon St., Port Orange, FL (US) 32127

( * ) Notice: Subject to any disclaimer, the term of this patent is extended or adjusted under 35 U.S.C. 154(b) by 0 days.

(21) Appl. No.: 11/999,531

(22) Filed: Dec. 6, 2007

Related U.S. Application Data

(60) Provisional application No. 60/903,400, filed on Feb. 26, 2007.

(51) Int. Cl.
*B63H 21/12* (2006.01)

(52) U.S. Cl. ..... 440/5; 114/151

(58) Field of Classification Search ..... 114/151, 114/150; 440/5, 6, 61 A, 61 R
See application file for complete search history.

(56) References Cited

U.S. PATENT DOCUMENTS 583,740 A 6/1897 Fryer
2,486,049 A 10/1949 Miller
2,766,715 A 10/1956 Waterval
2,936,730 A * 5/1960 Patty, Jr. ..... 440/56
3,010,424 A 11/1961 Peterson et al.
3,139,062 A 6/1964 Keefe
4,358,280 A * 11/1982 Jeanson et al. ..... 440/61 R
4,878,864 A 11/1989 Van Bentem
5,249,378 A 10/1993 Frame
5,476,400 A 12/1995 Theophanides
6,375,524 B1 4/2002 Commandeur et al.
6,672,236 B1 * 1/2004 Pinsof ..... 114/151
6,799,528 B1 10/2004 Bekker

OTHER PUBLICATIONS

Ohla® 200 Overhung Load Adaptors Descriptive Bulletin describing models 210, 210F, 215, 210-10, 210-12, and 215-12. (1 page).

* cited by examiner

*Primary Examiner*—Lars A Olson
(74) *Attorney, Agent, or Firm*—Paul S. Rooy P.A.

(57) ABSTRACT

A self-contained hydraulic thruster for vessel. The hydraulic thruster incorporates an elevated helm platform mounted to a base having reinforced base feet, and a hydraulic fluid reservoir mounted on the helm platform. The elevation of the hydraulic fluid reservoir facilitates flow of hydraulic fluid to a hydraulic power pack mounted on the base. A lower unit mounting tube is attached to the base, and at least one lower unit is mounted at an end of the lower unit mounting tube, laterally offset from the helm platform, so that when the lower unit is retracted and tilted up, it lies on one side of the platform, and the platform doesn't interfere with retraction and tilting of the lower unit. Lower units are pivotably mounted in lower unit housings with lower unit bushings, and steering is provided by a steering motor through an overhung load adaptor to a drive gear.

32 Claims, 10 Drawing Sheets

SELF-CONTAINED HYDRAULIC THRUSTER FOR VESSEL

CLAIM FOR PRIORITY

This utility patent application is based upon and claims the benefit of the earlier filing date of U.S. provisional patent application Ser. No. 60/903,400 filed Feb. 26, 2007 entitled Self-Contained Hydraulic Thruster for Vessel.

BACKGROUND OF THE INVENTION

Field of the Invention

This invention relates to vessel propulsion systems, and in particular to a self-contained hydraulic thruster for vessel.

Background of the Invention

Marine thrusters typically mount on barges and flat boats, and are used as propulsion for these vessels. One type of marine thruster employs a prime mover such as a diesel engine driving a hydraulic pump, together known as a "power pack", and the resultant pressurized hydraulic fluid may be employed to drive a propeller attached to a lower unit.

There are a number of problems associated with currently available marine thrusters. Where a centrally located tiltable lower unit has been retracted and tilted backwards for storage, maintenance, cleaning, etc., the protruding upper end of the lower unit interferes with the helm and helm platform, and prevents full upward tilting of the retracted lower unit. Therefore, it would be desirable to provide a marine thruster which may be retracted and then fully tilted.

Another problem with existing designs: the hydraulic fluid reservoir is disposed on the base of the marine thruster, where it is incapable of supplying enough fluid head to self-prime the power pack, and to facilitate hydraulic fluid flow to the hydraulic power pack. Thus, it would be desirable to provide a hydraulic fluid reservoir which is elevated above the level of the power pack.

Still another problem is where a marine thruster's single lower unit propeller does not supply enough power to adequately propel a vessel upon which it is mounted. It would therefore be desirable to provide a marine thruster with more than one lower unit, for increased power.

Other problems with existing designs include insufficient reinforcement at the lower unit tilt actuator attach point on the base, inadequate bearing surface at the lower unit pivot point, and excess steering motor stress.

Existing Designs

FIGS. 1 and 2 are illustrative of the tilt interference problem, and are rear views of a prior art marine thrusters 2. The location of their lower units 4 directly behind their respective helms causes interference between lower unit 4 and the helm when attempting to fully tilt lower unit 38 up when lower unit 38 is fully retractable. This interference prevents lower unit 38 from fully tilting up when it is fully retracted, thus hindering stowing of lower unit 38 for storage, transportation, servicing, or cleaning.

In addition, the mounting of the hydraulic fluid reservoir on the base of this design provides inadequate flow from the hydraulic fluid tank for self-priming and gravitational flow from hydraulic fluid tank to power pack.

SUMMARY OF THE INVENTION

It is an object of the present invention to provide a self-contained hydraulic thruster for vessel with an elevated hydraulic fluid reservoir. Design features allowing this object to be accomplished include a hydraulic fluid reservoir mounted on a helm platform which is elevated a substantial height above a base to which a hydraulic power pack is mounted. Benefits associated with the accomplishment of this object include power pack self-priming, and facilitated hydraulic fluid flow from the hydraulic fluid reservoir to the hydraulic power pack.

It is another object of the present invention to provide a self-contained hydraulic thruster for vessel whose lower unit (s) may be retracted and tilted up without interference from the helm platform. Design features allowing this object to be accomplished include at least one lower unit mounted at an end of a lower unit mounting tube, the lower unit being laterally offset from a steering platform. Advantages associated with the accomplishment of this object include more efficient lower unit stowing for storage and/or transportation, greater tilt achievable (close to 90 degrees), the ability to tilt the propellers and lower unit completely out of the water for servicing and cleaning, decreased corrosion due to the ability of getting the lower units and propellers completely out of the water when not in use to reduce corrosion, and greater retraction of the lower unit.

It is still another object of this invention to provide a self-contained hydraulic thruster for vessel whose lower units pivot smoothly and easily within respective lower unit bores in lower unit housings. Design features enabling the accomplishment of this object include at least one bushing inside a lower unit bore, and a lower unit bushing bore sized to slidably admit a lower unit. Advantages associated with the realization of this object include easier and smoother steering, and less force required to accomplish same.

It is another object of the present invention to provide a self-contained hydraulic thruster for vessel which is stable and well-supported on a vessel to which it is mounted. Design features allowing this object to be accomplished include a base having at least one base foot attached to a rear side of the base, with a base foot reinforcement plate and base foot center spar in the base foot. Benefits associated with the accomplishment of this object include better support for the self-contained hydraulic thruster for vessel, and greater operator security.

It is still another object of this invention to provide a self-contained hydraulic thruster for vessel whose steering is reliable and long-lived. Design features enabling the accomplishment of this object include a steering motor driving a drive gear through an overhung load adaptor. Advantages associated with the realization of this object include smoother steering function, longer-lived steering motor, and the associated reduced motor maintenance and replacement costs.

It is yet another object of this invention to provide a self-contained hydraulic thruster for vessel which is economical to build. Design features allowing this object to be achieved include the use of components made of readily available materials, and commercially available components such as an existing steering motor, overhung load adapter, hydraulic actuator, hydraulic power pack, hydraulic fluid reservoir, lower unit, propeller, steering gear, drive gear, and hydraulic lines. Benefits associated with reaching this objective include reduced cost, and hence increased availability.

BRIEF DESCRIPTION OF THE DRAWINGS

The invention, together with the other objects, features, aspects and advantages thereof will be more clearly understood from the following in conjunction with the accompanying drawings.

Ten sheets of drawings are provided. Sheet one contains FIGS. 1 and 2. Sheet two contains FIG. 3. Sheet three contains FIG. 4. Sheet four contains FIG. 5. Sheet five contains FIGS. 6 and 7. Sheet six contains FIGS. 8, 9 and 10. Sheet seven contains FIG. 11. Sheet eight contains FIG. 12. Sheet nine contains FIG. 13. Sheet ten contains FIG. 14.

DETAILED DESCRIPTION OF THE PREFERRED EMBODIMENT

Figure 3:
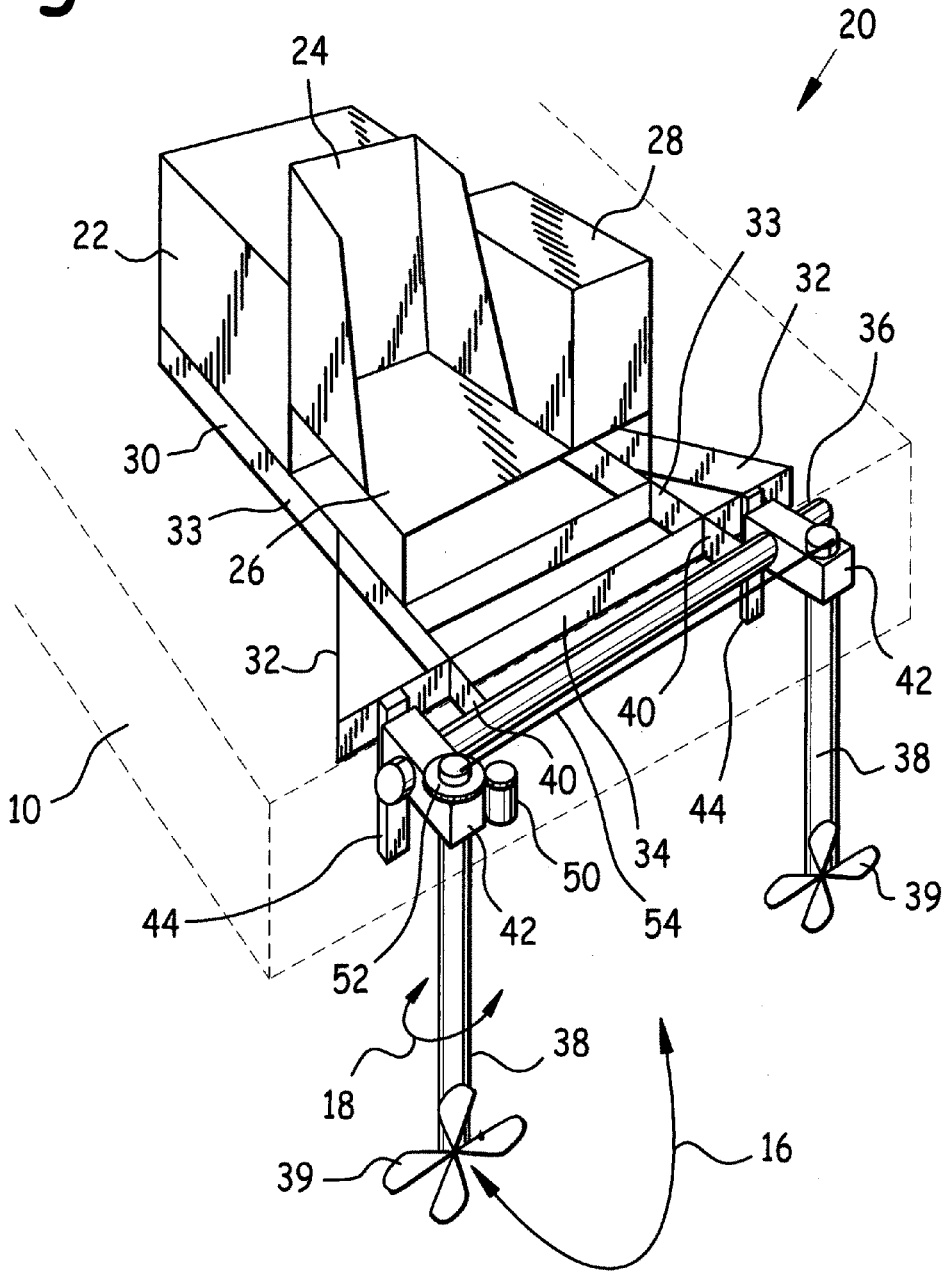
FIG. 3 is a rear quarter isometric view of a self-contained hydraulic thruster for vessel.

FIG. 3 is a rear quarter isometric view of self-contained hydraulic thruster 20. Hydraulic thruster 20 comprises base 30 which supports hydraulic power pack 22 and helm platform 26. Helm platform 26 in turn supports helm 24 and hydraulic fluid reservoir 28. Helm platform 26 is elevated above base 30 to elevate hydraulic fluid reservoir 28 above the level of hydraulic power pack 22, and for enhanced visibility for the vessel operator.

It is desirable to locate hydraulic fluid reservoir 28 above the level of hydraulic power pack 22 to render the hydraulic system self-priming, and to facilitate the flow of hydraulic fluid from hydraulic fluid reservoir 28 to the hydraulic fluid pump in hydraulic power pack 22. Hydraulic power pack 22 is a conventional, commercially available prime mover, such as a diesel engine, coupled to a hydraulic fluid pump, which supplies hydraulic fluid under pressure to power hydraulic thruster 20.

Base 30 may comprise one or more base feet 32 at its rear, each attached to a base side spar 33, to increase the stability of base 30 on the vessel 10 upon which hydraulic thruster 20 is mounted. One or more vessel stops 44 are mounted to base rear spar 34, and serve to help immobilize hydraulic thruster 20 atop a vessel 10 to which it is mounted, and also transmit force from propellers 39 to vessel 10.

One or more lower unit mounting tube supports 40 extend aft from base rear spar 34 and support lower unit mounting tube 36. One or more lower units 38 are mounted to lower unit mounting tube 36 by means of respective lower unit housings 42. In the preferred embodiment, two lower units 38 were mounted to opposite ends of lower unit mounting tube 36 by means of respective lower unit housings 42, laterally offset from helm platform 26 in order to permit full retraction and tilting up of lower units 38 to stow same for storage, transportation, servicing, cleaning, etc.

Each lower unit 38 is free to rotate within its respective lower unit housing 42 as indicated by arrow 18 in FIG. 3. Steering assembly 50 mounted to at least one lower unit housing 42 drives steering gear 52 attached to a lower unit 38. Steering assembly 50 causes steering gear 52 to rotate, which in turn causes an associated lower unit 38 to rotate as indicated by arrow 18 in FIG. 3, thus providing a steering function to hydraulic thruster 20. Tie rod 54 connects lower units 38 together, so that as steering assembly 50 causes one lower unit 38 to rotate, tie rod 54 causes the other lower unit(s) 38 entrained by tie rod 54 to rotate the same way.

Hydraulic fluid under pressure from hydraulic power pack 22 powers propeller(s) 39 on lower unit(s) 38, and may also serve as a power source for steering assembly 50.

Figure 4:
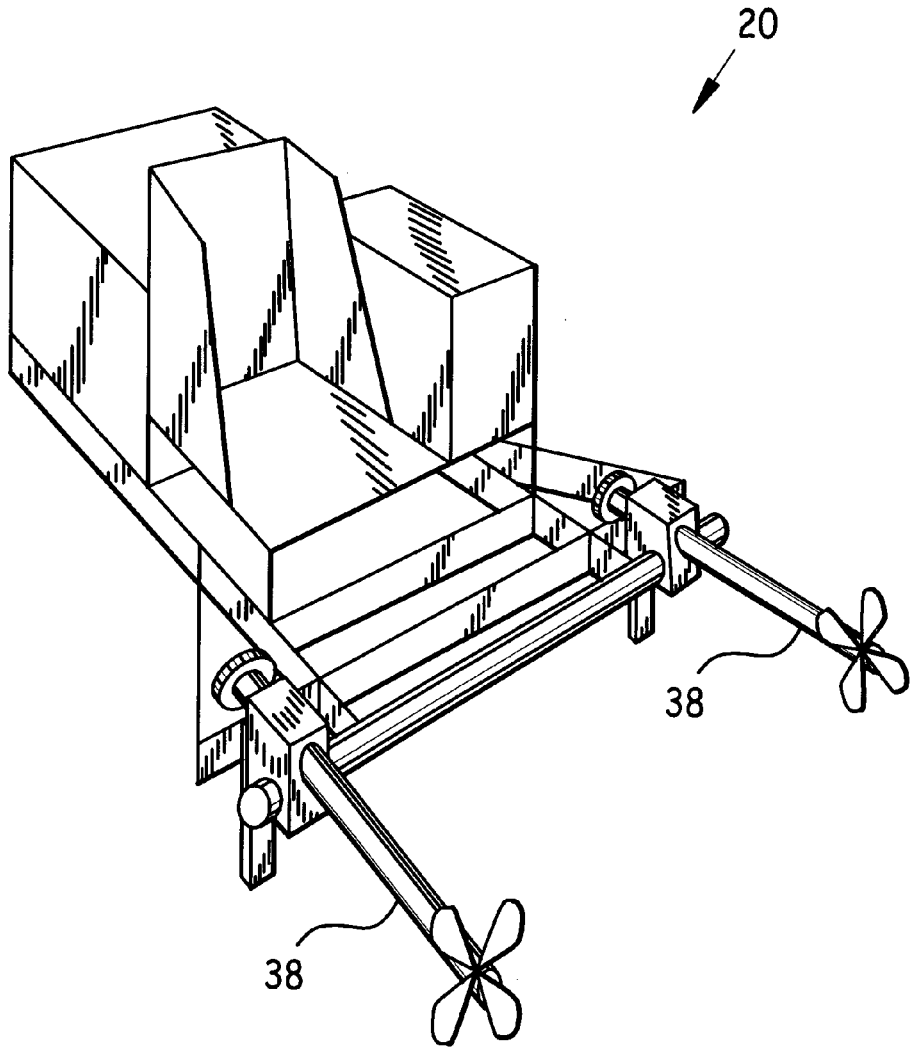
FIG. 4 is a side view of a self-contained hydraulic thruster for vessel with its lower units tilted up.

In the preferred embodiment, each lower unit housing 42 was free to rotate on lower unit mounting tube 36 as indicated by arrow 16 in FIG. 3. This rotational attachment of lower unit housing 42 on lower unit mounting tube 36 permits lower unit(s) 38 to tilt upwards close to 90 degrees from the down position depicted in FIGS. 3 and 5. FIG. 4 is a side view of a self-contained hydraulic thruster 20 with its lower units 38 tilted up.

Figure 5:
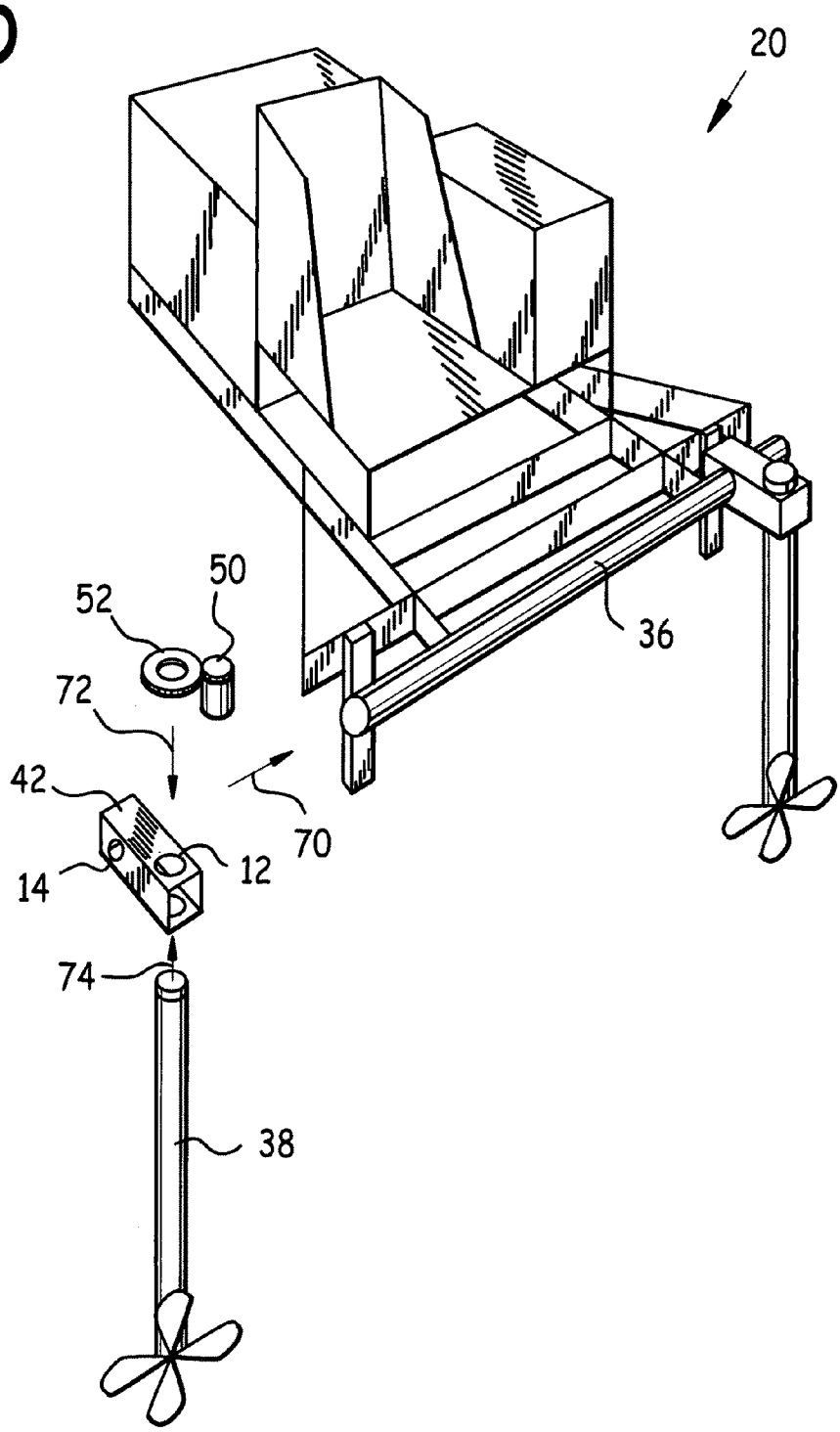
FIG. 5 is a rear quarter isometric view of a self-contained hydraulic thruster for vessel, with its left lower unit housing, left lower unit, steering assembly, and steering gear removed.

FIG. 5 is a rear quarter isometric view of a self-contained hydraulic thruster 20 for vessel, with its left lower unit housing 42, left lower unit 38, steering assembly 50 and steering gear 52 removed. Lower unit housing 42 comprises mounting tube bore 14 sized to slidably admit lower unit mounting tube 36, and lower unit bore 12 sized to slidably admit lower unit 38.

Due to the slidable attachment between mounting tube bore 14 and lower unit mounting tube 36, lower unit 38 is free to rotate on lower unit mounting tube 36 in order to tilt up and down, as indicated by arrow 16 in FIG. 3. Similarly, due to the slidable attachment between lower unit bore 12 and lower unit 38, lower unit 38 is free to pivot within lower unit bore 12 in order to provide a steering function, as indicated by arrow 18 in FIG. 3.

Lower unit housing 42 can be re-mounted on lower unit mounting tube 36 simply by sliding lower unit mounting tube 36 into mounting tube bore 14 as indicated by arrow 70 in FIG. 5. Lower unit 38 can be re-inserted into lower unit housing 42 by sliding it into lower unit bore 12 as indicated by arrow 74. Steering gear 52 can then be attached to lower unit 38, and steering assembly 50 mounted on lower unit housing 42, as indicated by arrow 72.

Figure 6:
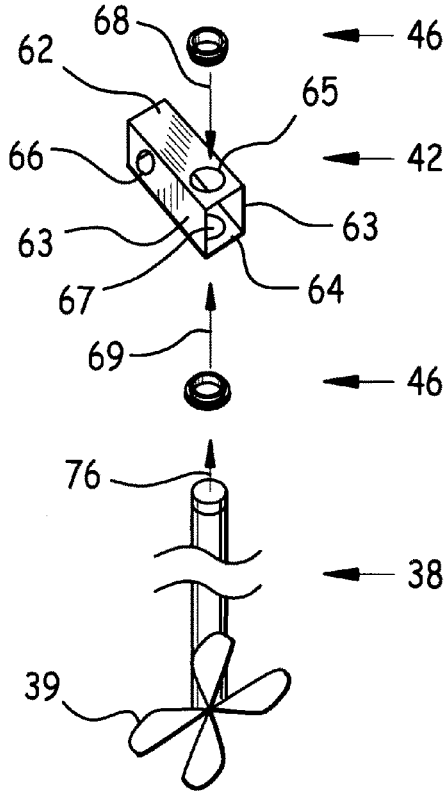
FIG. 6 is an exploded view of a lower unit, lower unit bushings, and lower unit housing.

FIG. 6 is an exploded view of lower unit housing 42, lower unit bushings 46, and lower unit 38 with propeller 39 attached. In the preferred embodiment, lower unit housing 42 comprised lower unit housing roof 62 with lower unit housing roof bore 65, lower unit housing walls 63, each with a lower unit housing wall bore 66, and lower unit housing floor 64 with lower unit housing floor bore 67. Lower unit housing wall bores 66 are sized to slidably admit lower unit mounting tube 36. Lower unit housing roof bore 65 and lower unit housing floor bore 67 are sized to slidably admit lower unit 38.

Figure 7:
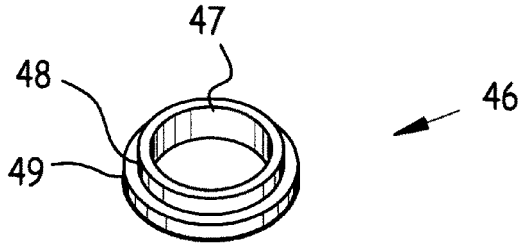
FIG. 7 is a front isometric view of a lower unit bushing.

An alternate embodiment hydraulic thruster 20 comprises lower unit bushings 46. As may be observed in FIG. 7, a front isometric view of lower unit bushing 46, lower unit bushing 46 comprises lower unit bushing lesser outside diameter 48, lower unit bushing greater outside diameter 49, and lower unit bushing bore 47. Lower unit bushing lesser outside diameter 48 is sized to slidably fit into lower unit housing roof bore 65 or lower unit housing floor bore 67. Lower unit bushing greater outside diameter 49 exceeds the diameter of lower unit housing roof bore 65 and the diameter of lower unit housing floor bore 67. Lower unit bushing bore 47 is sized to slidably admit lower unit 38.

As may be observed in FIG. 6, a lower unit bushing 46 is inserted into lower unit housing roof bore 65 as indicated by arrow 68, and a lower unit bushing 46 is inserted into lower unit housing floor bore 67 as indicated by arrow 69. Then lower unit 38 is inserted through the lower unit bushing bores 47 as indicated by arrow 76. In this embodiment, lower unit 38 turns within lower unit bushing bores 47, thus avoiding direct contact between lower unit 38 and lower unit housing roof bore 65 and lower unit housing floor bore 67.

Lower unit bushings 46 serve to cushion and reduce friction associated with the slidable attachment between lower unit housing 42 and lower unit 38. In the preferred embodiment, lower unit bushings 46 were made of nylon, synthetic, plastic, teflon, stainless steel or other metal or coated material, or other appropriate low-friction, corrosion-resistant material.

Figure 8:
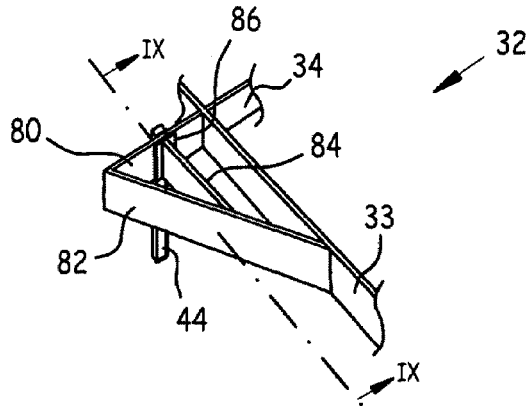
FIG. 8 is a front quarter isometric view of a base foot.

FIG. 8 is a front quarter isometric view of base foot 32. As may be observed in FIGS. 3 and 5, a base foot 32 may be disposed on either side of the aft end of base 30. In the preferred embodiment, base 30 incorporated base side spars 33, at whose aft end base feet 32 were attached, although it is intended to fall within this disclosure that base foot 32 may be attached to base 30 at any appropriate location or component of base 30.

Base foot 32 comprises base foot rear spar 80, and base foot side spar 82 attached at one end to base foot rear spar 80, and at the other to base side spar 33. In the preferred embodiment, base foot rear spar 80 was an end of base rear spar 34. Base foot 32 further comprises base foot reinforcement plate 86 attached to base foot rear spar 80 at vessel stop 44, and base foot center spar 84 attached at one end to base foot reinforcement plate 86, and at an opposite end to base foot side spar 82. Base foot reinforcement plate 86 and base foot center spar 84 serve to reinforce the structurally critical attach point of vessel stop 44 to base foot 32. In the preferred embodiment, base 30, base foot rear spar 80, base foot reinforcement plate 86, base foot side spar 82, and base foot center spar 84 were of welded metal construction.

Figure 9:
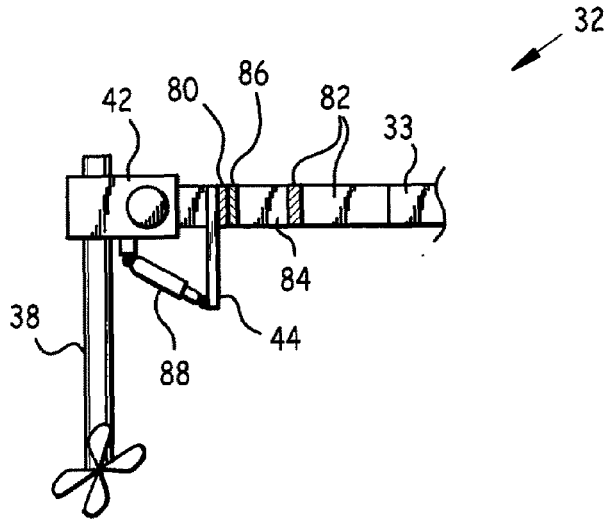
FIG. 9 is a side cross-sectional view of a base foot taken at section IX-IX of FIG. 8, showing the lower unit tilted down.
Figure 10:
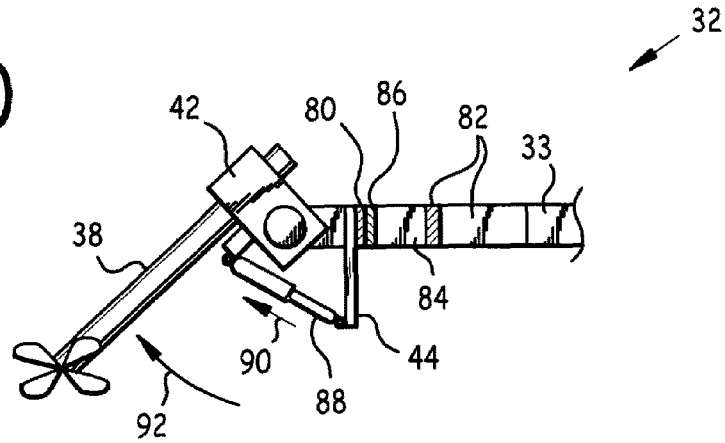
FIG. 10 is a side cross-sectional view of a base foot taken at section IX-IX of FIG. 8, showing the lower unit tilted up.

FIG. 9 is a side cross-sectional view of a base foot 32 taken at section IX-IX of FIG. 8, showing lower unit 38 tilted down. FIG. 10 is a side cross-sectional view of base foot 32 taken at section IX-IX of FIG. 8, showing lower unit 38 tilted up. Lower unit 38 is tilted up and down by actuator 88. Actuator 88 is attached at one end to lower unit housing 42, and at its other end to vessel stop 44. In the preferred embodiment, actuator 88 was a hydraulic actuator powered by pressurized hydraulic fluid from hydraulic power pack 22, and controlled from helm 24. Lower unit 38, steering assembly 50, and actuator 88 may be connected to hydraulic power pack 22 by any appropriate means, including hydraulic lines, which are not shown in the figures in interest of clarity.

When actuator 88 is extended or retracted as indicated by arrow 92 in FIG. 10, such movement by actuator 88 causes lower unit 38 to tilt up or down as indicated by arrow 92 in FIG. 10. The installation of lower unit(s) 38 laterally offset from elevated helm platform 26 permits lower unit(s) 38 to be tilted up close to 90 degrees from full down, even when lower unit(s) 38 are fully retracted, as depicted in FIG. 14.

Figure 11:
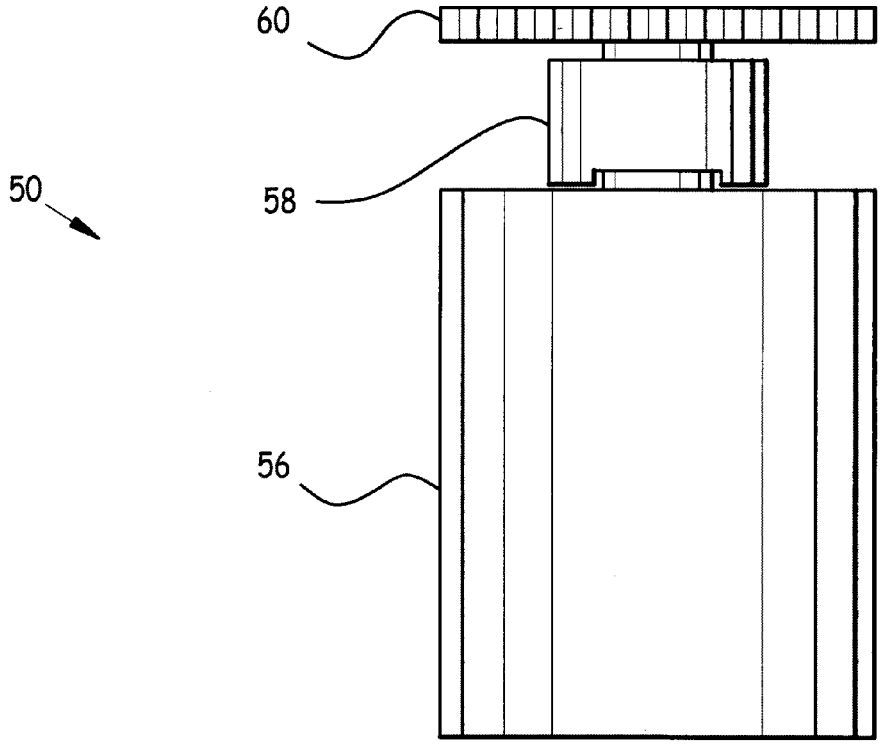
FIG. 11 is a front isometric view of a steering assembly.

FIG. 11 is a front isometric view of steering assembly 50. Steering assembly 50 comprises drive gear 60 sized to mesh with steering gear 52, and steering motor 56. Drive gear 60 is attached to steering motor 56 through overhung load adaptor 58. Overhung load adaptor 58 is attached to steering motor 56, and serves to transfer rotational motion from the output shaft of steering motor 56 to drive gear 60, while minimizing stress put on the internal bearings of steering motor 56, thus prolonging the life of steering motor 56. In the preferred embodiment, overhung load adaptor 58 was a commercially available overhung load adaptor.

Figure 12:
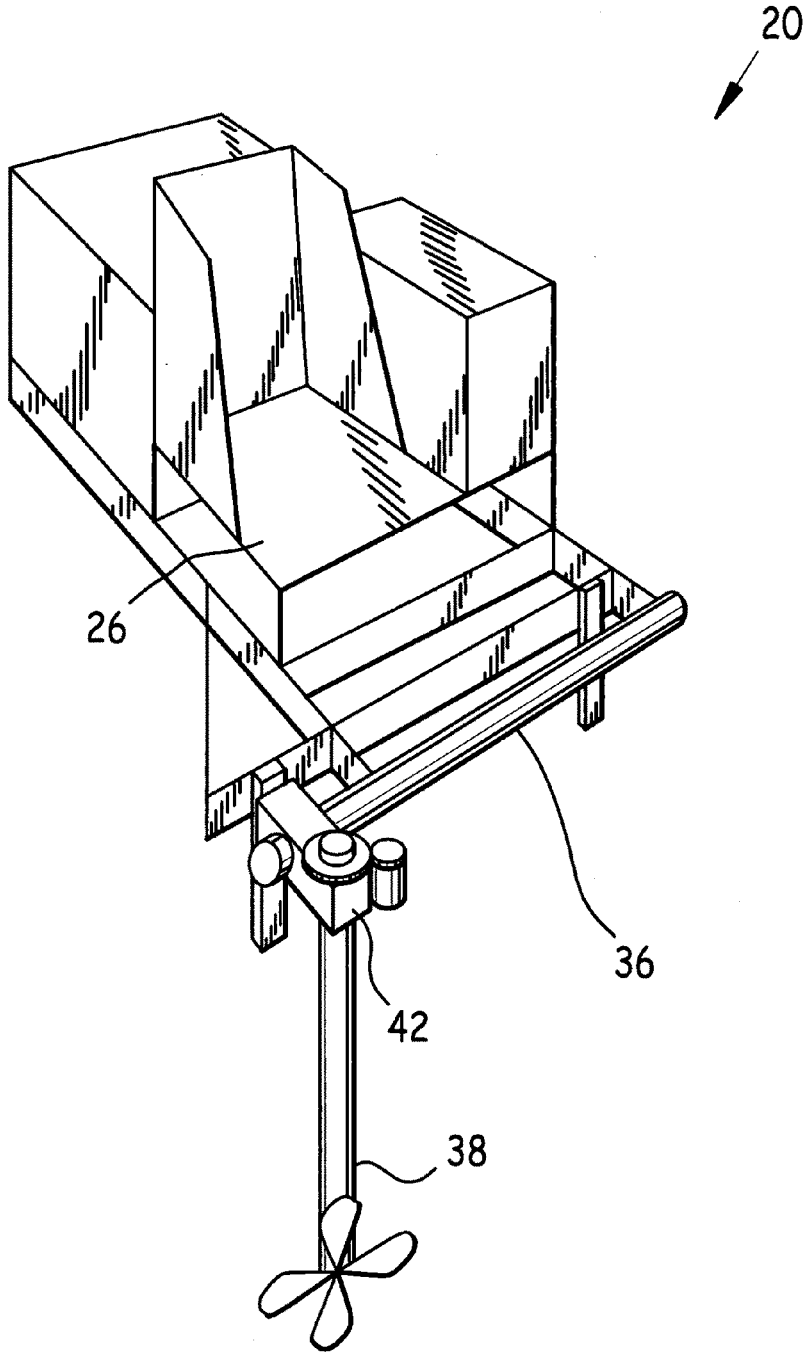
FIGS. 12-14 depict rear quarter isometric views of an alternate embodiment self-contained hydraulic thruster for vessel having a single lower unit 38 offset from the helm platform to permit full retraction and tilting up of the lower unit.
Figure 13:
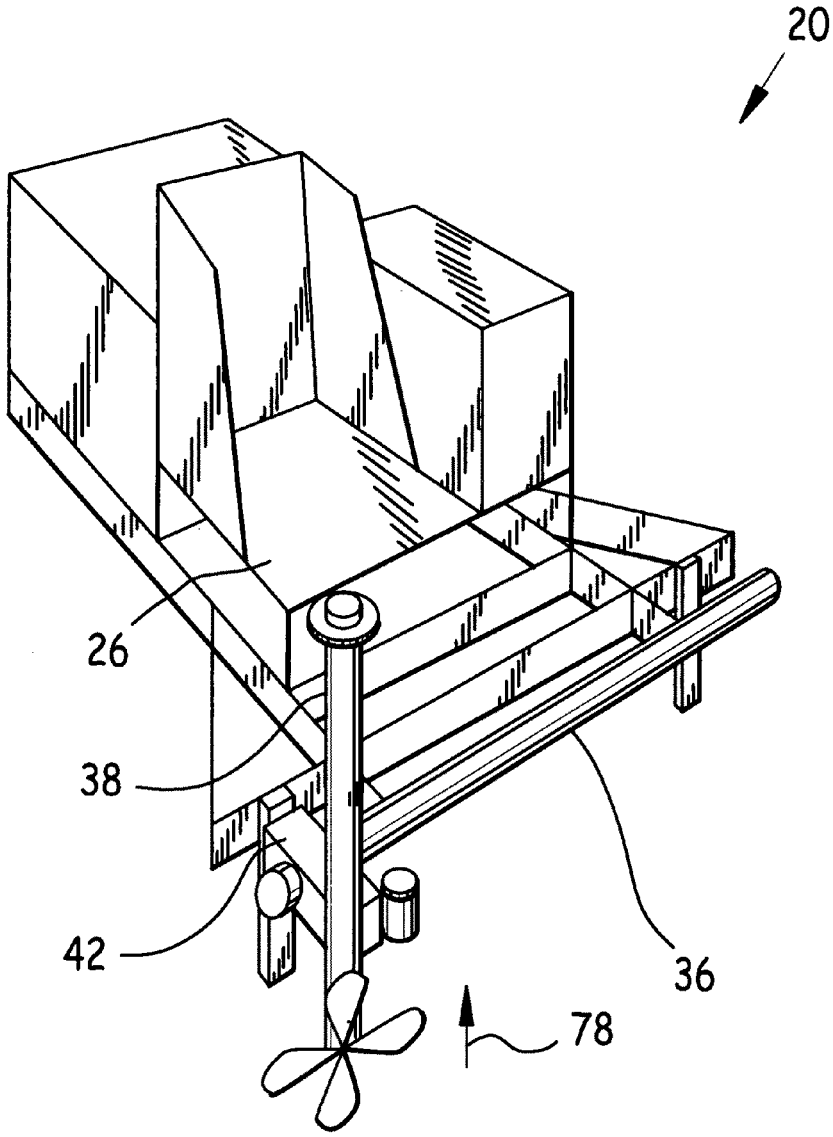
Figure 14:
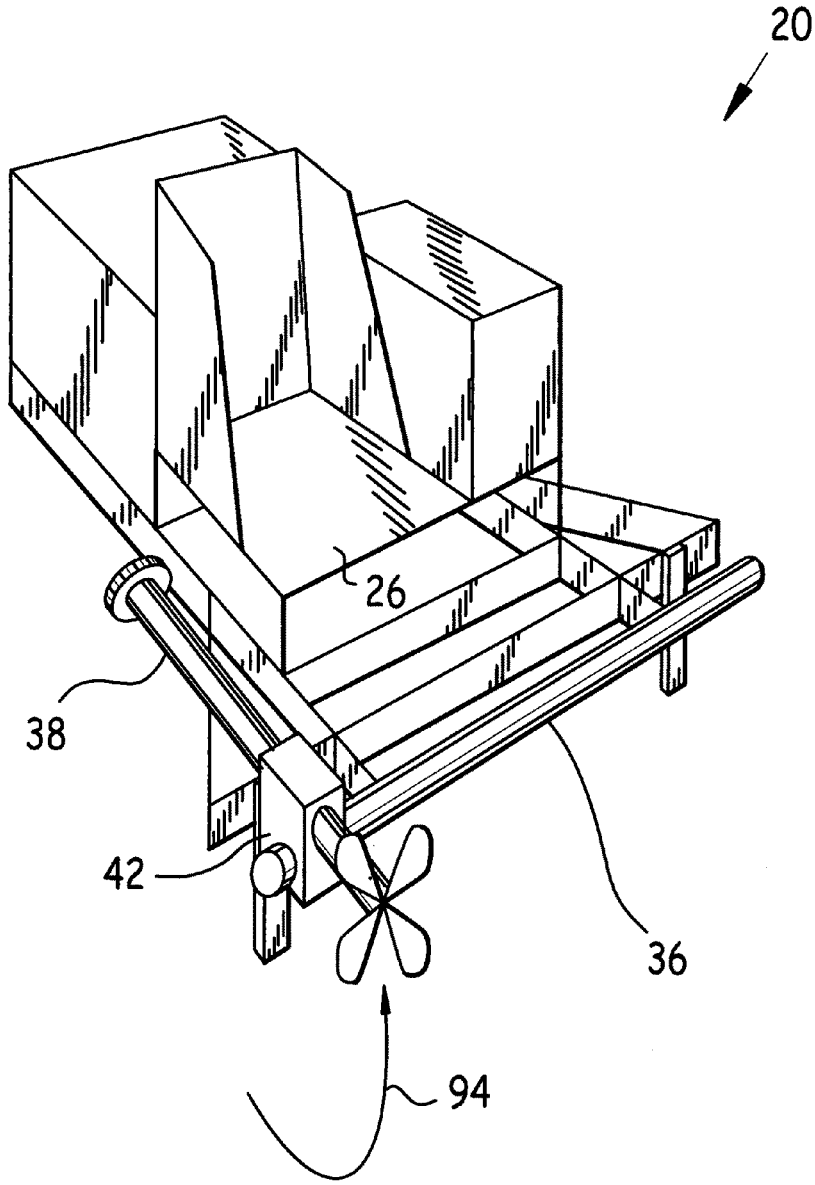

FIGS. 12-14 depict rear quarter isometric views of an alternate embodiment self-contained hydraulic thruster 20 for vessel comprising a single lower unit 38 mounted to a single base foot 32. In this embodiment, a single lower unit 38 is mounted at an end of lower unit mounting tube 36 offset from helm platform 26. The offset mounting of lower unit 38 incorporated into this embodiment is important to stow lower unit 38, for transportation, storage, servicing, and cleaning of hydraulic thruster 20.

Due to the slidable attachment of lower unit 38 and lower unit housing 42, lower unit 38 is not only free to pivot, but can also be retracted as indicated by arrow 78 in FIG. 13. Lower unit 38 can be retracted not only for transportation and storage of hydraulic thruster 20, but also to allow hydraulic thruster 20 to be used in shallow water.

Figure 1:
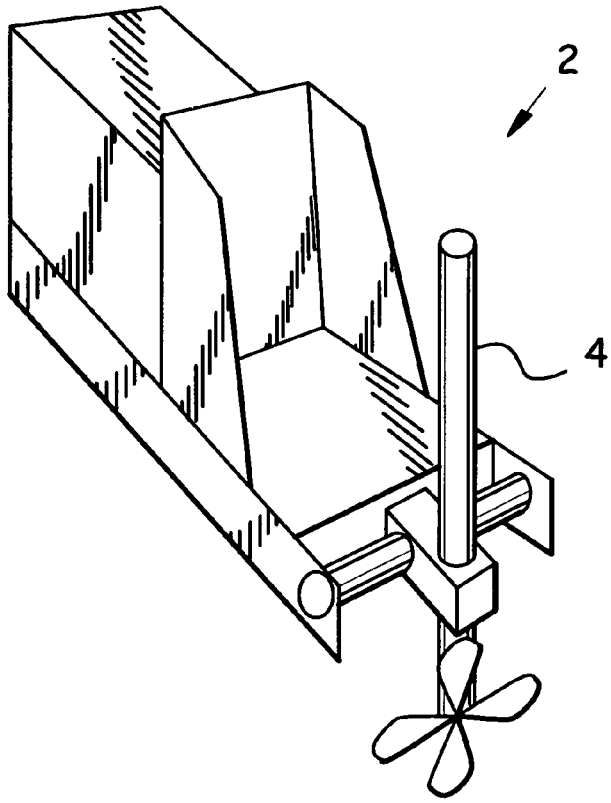
Fig. 1 PRIOR ART
FIGS. 1 and 2 are rear views of a prior art marine thruster.
Figure 2:
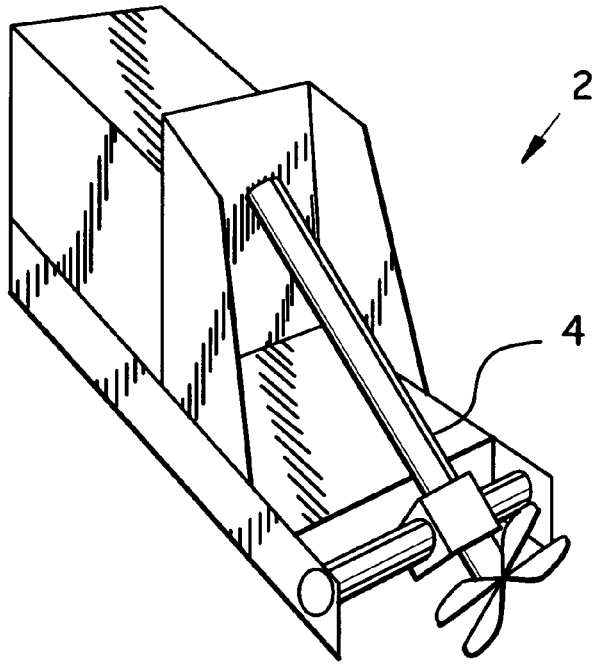
Fig. 2 PRIOR ART

Lower unit(s) 38 may be then stowed for transportation, servicing, cleaning and/or storage by tilting up lower unit 38 as indicated by arrow 94 in FIG. 14. It can be readily appreciated that if lower unit 38 were to be centrally mounted on lower unit mounting tube 38, as is depicted in the prior art marine thrusters of FIGS. 1 and 2, the elevated nature of helm platform 26 would interfere with the tilting up of lower unit 38 for storage and transportation: it would not be possible to fully tilt up lower unit 38 due to interference between the upper part of lower unit 38 and helm platform 26. Thus, the mounting of lower unit 38 at an end of lower unit mounting tube 36 laterally offset from elevated helm platform 26 permits more efficient storage and transportation of hydraulic thruster 20, by permitting lower unit 38 to be fully tilted when it is fully retracted, as depicted in FIG. 14.

When mounted on a vessel 10, the alternate embodiment hydraulic thruster 20 depicted in FIGS. 12-14 is positioned such that lower unit 38 is at the centerline of vessel 10, so as to provide laterally symmetrical thrust, and to avoid a turning tendency due to non-centrally located propulsion. It may be noted that the mounting of lower units 38 at either end of lower unit mounting tube 36 in the embodiment depicted in FIGS. 3 and 5, laterally offset from elevated helm platform 26, also permits these lower units to be completely tilted when retracted, for optimal storage and/or transportation.

In the interest of saving material and cost, a single base foot 32 may be incorporated into the single lower unit hydraulic thruster 20 embodiment depicted in FIGS. 12-14, on the same side as the single lower unit 38. In addition, lower unit mounting tube 36 could extend laterally only to the width of the base side spar 33 on the side of base 30 opposite the single lower unit 38, and the vessel stop 44 on that side could then be attached to base rear spar 34, not base foot 32. This single base foot 32 embodiment is depicted in FIG. 12.

In the preferred embodiment, base 30, helm platform 26, helm 24, hydraulic fluid reservoir 28, base feet 32, lower unit mounting tube supports 40 and lower unit housing(s) 42 were made using metal, synthetic, corrosion resistant metal, corrosion resistant metal fasteners, welded construction, or other appropriate materials and processes.

Base 30 structural members such as base side spars 33, base rear spar 34, base foot 32, and lower unit mounting tube support(s) 40 may be plates, C beams, I beams, or any other appropriate structural member shape. Steering motor 56, overhung load adaptor 58, drive gear 60, steering gear 52, and hydraulic power pack 22 were commercially available items.

While a preferred embodiment of the invention has been illustrated herein, it is to be understood that changes and variations may be made by those skilled in the art without departing from the spirit of the appending claims.

DRAWING ITEM INDEX

2 prior art marine thruster
4 prior art marine thruster lower unit
10 vessel
12 lower unit bore
14 mounting tube bore
16 arrow
18 arrow
20 hydraulic thruster
22 hydraulic power pack
24 helm
26 helm platform
28 hydraulic fluid reservoir
30 base
32 base foot
33 base side spar
34 base rear spar
36 lower unit mounting tube
38 lower unit
39 propeller
40 lower unit mounting tube support
42 lower unit housing
44 vessel stop
46 lower unit bushing
47 lower unit bushing bore
48 lower unit bushing lesser outside diameter
49 lower unit bushing greater outside diameter
50 steering assembly
52 steering gear
54 tie rod
56 steering motor
58 overhung load adaptor
60 drive gear
62 lower unit housing roof
63 lower unit housing wall
64 lower unit housing floor
65 lower unit housing roof bore
66 lower unit housing wall bore
67 lower unit housing floor bore
68 arrow
69 arrow
70 arrow
72 arrow
74 arrow
76 arrow
78 arrow
80 base foot rear spar
82 base foot side spar
84 base foot center spar
86 base foot reinforcement plate
88 actuator
90 arrow
92 arrow
94 arrow

I claim:

1. A hydraulic thruster comprising a helm platform mounted on a base, a lower unit mounting tube rigidly mounted at an aft end of said base in a substantially horizontal orientation, and at least one lower unit tiltably and retractably attached to said lower unit mounting tube, each said lower unit being mounted at an end of said lower unit mounting tube laterally offset from said helm platform.

2. The hydraulic thruster of claim 1 comprising a single said lower unit tiltably attached at an end of said lower unit mounting tube.

3. The hydraulic thruster of claim 1 wherein said helm platform is mounted a substantial height above said base, and wherein a shape of said helm platform is substantially flat and planar.

4. A hydraulic thruster comprising a helm platform mounted on a base, a lower unit mounting tube mounted at an aft end of said base, and a lower unit tiltably and retractable attached at each end of said lower unit mounting tube, each said lower unit being mounted at an end of said lower unit mounting tube laterally offset from said helm platform.

5. A hydraulic thruster comprising a helm platform mounted on a base, a lower unit mounting tube mounted at an aft end of said base, at least one lower unit tiltably attached to said lower unit mounting tube, each said lower unit being mounted at an end of said lower unit mounting tube laterally offset from said helm platform, a hydraulic power pack mounted on said base, and a hydraulic fluid reservoir mounted on said helm platform, whereby a substantial height of said helm platform upon which said hydraulic fluid reservoir is mounted facilitates flow of hydraulic fluid from said hydraulic fluid reservoir to said power pack and renders said hydraulic power pack self-priming.

6. A hydraulic thruster comprising a helm platform mounted on a base, a lower unit mounting tube mounted at an aft end of said base, at least one lower unit tiltably attached to said lower unit mounting tube, each said lower unit being mounted at an end of said lower unit mounting tube laterally offset from said helm platform, a lower unit housing corresponding to each said lower unit, each said lower unit housing comprising a mounting tube bore sized to slidably admit said lower unit mounting tube, said lower unit housing further comprising a lower unit bore sized to slidably admit said lower unit, whereby said lower unit may pivot within said lower unit bore and thereby provide a steering function to said hydraulic thruster, and whereby said lower unit may be retracted for transportation or storage.

7. The hydraulic thruster of claim 6 further comprising at least one lower unit bushing, said lower unit bushing comprising a lower unit bushing lesser outside diameter, a lower unit bushing greater outside diameter, and a lower unit bushing bore, said lower unit bushing lesser outside diameter being sized to slidably fit into said lower unit bore, said lower unit bushing greater outside diameter exceeding a diameter of said lower unit bore, and said lower unit bushing bore being sized to slidably admit said lower unit.

8. The hydraulic thruster of claim 6 further comprising a steering gear attached to at least one said lower unit and a steering assembly mounted to a corresponding said housing, said steering assembly comprising a steering motor driving a drive gear through an overhung load adaptor, said drive gear meshing with said steering gear.

9. A hydraulic thruster comprising a helm platform mounted on a base, a lower unit mounting tube mounted at an aft end of said base, at least one lower unit tiltably attached to said lower unit mounting tube, each said lower unit being mounted at an end of said lower unit mounting tube laterally offset from said helm platform, a lower unit housing corresponding to each said lower unit, each said lower unit housing comprising a lower unit housing roof having a lower unit housing roof bore, a lower unit housing wall having a lower unit housing wall bore, and a lower unit housing floor having a lower unit housing floor bore, said lower unit housing wall bore being sized to slidably admit said lower unit mounting tube, and said lower unit roof bore and said lower unit housing floor bore being sized to slidably admit said lower unit.

10. The hydraulic thruster of claim 9 further comprising at least one lower unit bushing, each said lower unit bushing comprising a lower unit bushing lesser outside diameter, a lower unit bushing greater outside diameter, and a lower unit bushing bore, said lower unit bushing lesser outside diameter being sized to slidably fit into said lower unit housing roof bore or said lower unit housing floor bore, said lower unit bushing greater outside diameter exceeding a diameter of said lower unit housing roof bore and a diameter of said lower unit housing floor bore, and said lower unit bushing bore being sized to slidably admit said lower unit.

11. A hydraulic thruster comprising a helm platform mounted on a base; a lower unit mounting tube mounted at an aft end of said base; at least one lower unit tiltably attached to said lower unit mounting tube, each said lower unit being mounted at an end of said lower unit mounting tube laterally offset from said helm platform; at least one base foot attached at an aft side of said base; each said base foot comprising a base foot rear spar, a vessel stop attached to an aft side of said base foot rear spar and extending downwards from said base foot rear spar, a base foot side spar attached at one end to said base foot rear spar and at an opposite end to a side of said base, a base foot reinforcement plate attached to said base foot rear spar at said vessel stop, and a base foot center spar attached at one end to said base foot rear spar and at an opposite end to said base foot side spar.

12. A hydraulic thruster comprising a substantially flat and planar helm platform mounted a substantial height above a base, a lower unit mounting tube rigidly mounted at an aft end of said base in a substantially horizontal orientation, a lower unit tiltably attached to said lower unit mounting tube at an end of said lower unit mounting tube extending laterally beyond said elevated helm platform, whereby when said lower unit is retracted and tilted up, said lower unit is disposed along one side of said helm platform.

13. A hydraulic thruster comprising a helm platform mounted on a base, a lower unit mounting tube mounted at an aft end of said base, and a lower unit tiltably attached to each end of said lower unit mounting tube laterally offset from said helm platform, whereby when said lower units are retracted and tilted up, said lower units are disposed along opposite sides of said helm platform.

14. The hydraulic thruster of claim 13 wherein said helm platform is mounted a substantial height above said base, and said hydraulic thruster further comprises a hydraulic power pack mounted on said base, and a hydraulic fluid reservoir mounted on said helm platform, whereby said substantial height of said helm platform upon which said hydraulic fluid reservoir is mounted facilitates flow of hydraulic fluid from said hydraulic fluid reservoir to said power pack and renders said hydraulic power pack self-priming.

15. The hydraulic thruster of claim 14 further comprising a lower unit housing corresponding to each said lower unit, each said lower unit housing comprising a mounting tube bore sized to slidably admit said lower unit mounting tube, said lower unit housing further comprising a lower unit bore sized to slidably admit said lower unit, whereby said lower unit may pivot within said lower unit bore and thereby provide a steering function to said hydraulic thruster, and whereby said lower unit may be retracted for transportation or storage.

16. The hydraulic thruster of claim 15 further comprising at least one lower unit bushing, said lower unit bushing comprising a lower unit bushing lesser outside diameter, a lower unit bushing greater outside diameter, and a lower unit bushing bore, said lower unit bushing lesser outside diameter being sized to slidably fit into said lower unit bore, said lower unit bushing greater outside diameter exceeding a diameter of said lower unit bore, and said lower unit bushing bore being sized to slidably admit said lower unit.

17. The hydraulic thruster of claim 16 further comprising a steering gear attached to one said lower unit and a steering assembly mounted to a corresponding said housing, said steering assembly comprising a steering motor driving a drive gear through an overhung load adaptor, said drive gear meshing with said steering gear.

18. The hydraulic thruster of claim 17 wherein said base further comprises at least one base foot attached at an aft side of said base, each said base foot comprising a base foot rear spar, a vessel stop attached to an aft side of said base foot rear spar and extending downwards from said base foot rear spar, a base foot side spar attached at one end to said base foot rear spar and at an opposite end to a side of said base, a base foot reinforcement plate attached to said base foot rear spar at said vessel stop, and a base foot center spar attached at one end to said base foot rear spar and at an opposite end to said base foot side spar.

19. A hydraulic thruster comprising a helm platform mounted on a base, a lower unit mounting tube rigidly mounted at an aft end of said base in a substantially horizontal orientation, and a lower unit tiltably attached to one end of said lower unit mounting tube laterally offset from said helm platform, whereby when said lower unit is retracted and tilted up, said lower unit is disposed along a side of said helm platform.

20. A hydraulic thruster comprising a helm platform mounted on a base; a lower unit mounting tube mounted at an aft end of said base; a lower unit tiltably attached to one end of said lower unit mounting tube laterally offset from said helm platform, whereby when said lower unit is retracted and tilted up said lower unit is disposed along a side of said helm platform; said helm platform being mounted a substantial height above said base; said hydraulic thruster comprising a hydraulic power pack mounted on said base, and a hydraulic fluid reservoir mounted on said helm platform, whereby said substantial height of said helm platform upon which said hydraulic fluid reservoir is mounted facilitates flow of hydraulic fluid from said hydraulic fluid reservoir to said power pack and renders said hydraulic power pack self-priming.

21. The hydraulic thruster of claim 20 further comprising a lower unit housing corresponding to said lower unit, said lower unit housing comprising a mounting tube bore sized to slidably admit said lower unit mounting tube, said lower unit housing further comprising a lower unit bore sized to slidably admit said lower unit, whereby said lower unit may pivot within said lower unit bore and thereby provide a steering function to said hydraulic thruster, and whereby said lower unit may be retracted for transportation or storage.

22. The hydraulic thruster of claim 21 further comprising at least one lower unit bushing, each said lower unit bushing comprising a lower unit bushing lesser outside diameter, a lower unit bushing greater outside diameter, and a lower unit bushing bore, said lower unit bushing lesser outside diameter being sized to slidably fit into said lower unit bore, said lower unit bushing greater outside diameter exceeding a diameter of said lower unit bore, and said lower unit bushing bore being sized to slidably admit said lower unit.

23. The hydraulic thruster of claim 22 further comprising a steering gear attached to one said lower unit and a steering assembly mounted to a corresponding said housing, said steering assembly comprising a steering motor driving a drive gear through an overhung load adaptor, said drive gear meshing with said steering gear.

24. The hydraulic thruster of claim 23 wherein said base further comprises at least one base foot attached at an aft side of said base, each said base foot comprising a base foot rear spar, a vessel stop attached to an aft side of said base foot rear spar and extending downwards from said base foot rear spar, a base foot side spar attached at one end to said base foot rear spar and at an opposite end to a side of said base, a base foot reinforcement plate attached to said base foot rear spar at said vessel stop, and a base foot center spar attached at one end to said base foot rear spar and at an opposite end to said base foot side spar.

25. A hydraulic thruster comprising a helm platform mounted substantially above a base, a lower unit mounting tube rigidly mounted at an aft end of said base in a substantially horizontal orientation, and a first lower unit tiltably attached to one end of said lower unit mounting tube laterally offset from said helm platform, whereby when said first lower unit is retracted and tilted up, said lower unit is disposed along a side of said helm platform, said first lower unit comprising a propeller.

26. The hydraulic thruster of claim 25 further comprising an actuator between said base and said first lower unit, whereby said actuator may cause said lower unit to tilt up and down.

27. The hydraulic thruster of claim 26 further comprising a vessel stop attached to said base, said actuator attached at one end to said vessel stop and at an opposite end to said lower unit.

28. A hydraulic thruster comprising a helm platform mounted substantially above a base; a lower unit mounting tube mounted at an aft end of said base; a first lower unit tiltably attached to one end of said lower unit mounting tube laterally offset from said helm platform, whereby when said first lower unit is retracted and tilted up, said lower unit is disposed along a side of said helm platform; said first lower unit comprising a propeller; a hydraulic power pack mounted on said base; and a hydraulic fluid reservoir mounted on said helm platform, whereby said substantial height of said helm platform upon which said hydraulic fluid reservoir is mounted facilitates flow of hydraulic fluid from said hydraulic fluid reservoir to said power pack and renders said hydraulic power pack self-priming.

29. The hydraulic thruster of claim 28 wherein said base further comprises a base side spar along each side of said base, a base rear spar along a rear of said base, and said lower unit mounting tube is mounted to said base rear spar by means of at least one lower unit mounting tube support.

30. The hydraulic thruster of claim 29 further comprising a second lower unit tiltably attached to an end of said lower unit mounting tube opposite said first lower unit and laterally offset from said helm platform, whereby when said second lower unit is retracted and tilted up, said lower unit is disposed along a side of said helm platform.

31. The hydraulic thruster of claim further 30 comprising a tie rod connecting said first lower unit and said second lower unit, whereby steering inputs into said first lower unit are transmitted to said second lower unit.

32. The hydraulic thruster of claim 28 further comprising a helm on said helm platform.

* * * * *

UNITED STATES PATENT AND TRADEMARK OFFICE

CERTIFICATE OF CORRECTION

PATENT NO. : 7,654,875 B1
APPLICATION NO. : 11/999531
DATED : February 2, 2010
INVENTOR(S) : John T. Williams It is certified that error appears in the above-identified patent and that said Letters Patent is hereby corrected as shown below:

Column 8 Line 7:

Is: "...and retractable..."
Should Be: "...and retractably..."

Signed and Sealed this

Twentieth Day of April, 2010

David J. Kappos

David J. Kappos
*Director of the United States Patent and Trademark Office*